US007367298B2

(12) United States Patent
Meyer et al.

(10) Patent No.: US 7,367,298 B2
(45) Date of Patent: May 6, 2008

(54) VARIABLE VALVE GEAR FOR INTERNAL COMBUSTION ENGINE

(75) Inventors: Markus Meyer, Mildenau (DE); Andreas Werler, Zwickau (DE); Jörg Wutzler, Zwickau (DE)

(73) Assignee: IAV GmbH Ingenieurgesellschaft Auto und Verkehr, Berlin (DE)

( * ) Notice: Subject to any disclaimer, the term of this patent is extended or adjusted under 35 U.S.C. 154(b) by 103 days.

(21) Appl. No.: 11/494,202

(22) Filed: Jul. 27, 2006

(65) Prior Publication Data

US 2007/0022989 A1 Feb. 1, 2007

(30) Foreign Application Priority Data

Jul. 28, 2005 (DE) ..... 10 2005 035 315

(51) Int. Cl.
*F01L 1/34* (2006.01)

(52) U.S. Cl. ..... 123/90.16; 123/90.15; 123/90.17; 123/90.31

(58) Field of Classification Search ..... 123/90.16
See application file for complete search history.

(56) References Cited

U.S. PATENT DOCUMENTS 4,572,118 A * 2/1986 Baguena ..... 123/90.16
6,955,146 B2 10/2005 Werler
7,222,596 B2 * 5/2007 Stiegler ..... 123/90.16

FOREIGN PATENT DOCUMENTS

DE 100 31 783 A1 1/2002
DE 100 61 618 A1 6/2002
DE 202 20 138 6/2004
DE 103 39 658 A1 3/2005
DE 2005 006 309 9/2005

OTHER PUBLICATIONS

DE 10 2004 010 418.2, Germany-Spec (to follow).

* cited by examiner

*Primary Examiner*—Thomas Denion
*Assistant Examiner*—Kyle M. Riddle
(74) *Attorney, Agent, or Firm*—Collard & Roe, P.C.

(57) ABSTRACT

A variable valve gear for internal combustion engines, having at least one camshaft and pivot lever disposed in the cylinder head, which lever contacts a valve that closes by means of spring force. An intermediate element of a transfer element is mounted in a supporting and displaceable manner, twice on the supporting body and on the pivot lever. The intermediate element engages a supporting surface disposed on the supporting body, first by way of a supporting cam segment disposed on the intermediate element, and second with the controlling cam segment of the supporting body, and third with the pivot lever, by way of an outer contour surface disposed on the intermediate element. The intermediate element indirectly contacts the cam of the camshaft, by way of a roller disposed on an oscillating crank, which is connected with the intermediate element in articulated manner.

10 Claims, 5 Drawing Sheets

VARIABLE VALVE GEAR FOR INTERNAL COMBUSTION ENGINE

BACKGROUND OF THE INVENTION

1. Field of the Invention

The invention relates to a variable valve gear for internal combustion engines.

2. The Prior Art

A device for variable activation of valves by cams is described in German Patent No. DE 100 61 618 B4. This device is disposed in a cylinder head with a camshaft that is mounted in a fixed position, with valves that close by means of spring force, and together with a stroke transfer arrangement assigned to each of the valves, is guided in the cylinder head in a fixed position. An element that is adjustable for valve stroke adjustment is disposed in the cylinder head, mounted in a fixed position but so as to pivot. It has a supporting cam segment and a controlling cam segment, which run one after the other in an axial plane. An intermediate element is prismatically supported on the element that can be changed in its position, both on the supporting cam segment and the controlling cam segment, with a non-positive lock, and is guided to pivot and glide on the two cam segments in this connection, during the stroke movement. Furthermore, the intermediate element engages one of the cams of the camshaft as well as with a stroke transfer arrangement for a valve. The controlling cam segment determines the movement path of the intermediate element during the stroke of the cam as a function of the pivot position of the changeable element, and thereby the amount of the stroke brought about at the valve by the stroke transfer arrangement.

The design configuration of this embodiment is limited, because the supporting cam segment and the controlling cam segment are disposed running one after the other on the element that can be changed in its position, and therefore a certain distance between the two prismatic engagement lines on the supporting cam segment and the controlling cam segment as well as the intermediate element is necessary.

A variable valve drive for internal combustion engines is described in German Patent Application No. DE 100 31 783 A1, having a valve arrangement moved indirectly by a cam, by way of a rocker or toggle lever mounted directly or indirectly on the cylinder head, so as to pivot. This arrangement has one or more valves that close under the effect of a spring. The rocker or toggle lever engages an intermediate lever that is guided to have a rocking movement. This intermediate lever engages, in sliding or rolling manner, the cam of a camshaft, and a controlling cam segment of a supporting body mounted directly or indirectly on the cylinder head, so as to rotate. The supporting body determines the amount of the valve stroke with its position and the region of a controlling cam segment that becomes effective thereby. The angle position of the supporting body can be adjusted by means of a suitable control and a corresponding actuator.

The complicated and high-effort structure of the adjustment mechanism for changing the stroke of the valve opening range is a disadvantage in this connection. Furthermore, simultaneous adjustment of the valve stroke and the valve opening range cannot be carried out at the same time with the state of the art as described.

In German Patent Application NO. DE 10 2004 010 418.2, which was not published prior to this application, a variable valve gear with an adjustable valve stroke is described, in which forward displacement of the valve opening range automatically takes place in the case of an adjustment in the direction toward a lesser stroke. In this connection, an intermediate lever stands in an effect connection with a pivot lever that activates a valve, by way of a roller disposed on the intermediate lever, and with a supporting cam segment disposed on a pivoting supporting body, and it contacts the cam contour of the camshaft by way of a roller disposed on the intermediate lever. An oscillating guide crank pivots on the intermediate lever, which crank is disposed on a setting arm coupled with the supporting body, in articulated manner.

Introduction of force into the valve gear, which is caused by the displacement of the intermediate lever by the cam contour, is a disadvantage in this connection. Furthermore, this solution requires a relative great construction space.

SUMMARY OF THE INVENTION

It is therefore an object of the invention to create a variable valve gear for an internal combustion engine in which adjustment of the valve opening and/or valve closing angle takes place earlier or later, with a reduction of the forces that occur and the construction space that is required. At the same time, adjustment of the valve stroke height can take place.

According to the invention, this task is accomplished by a variable valve gear for internal combustion engines, having at least one camshaft and a pivot lever disposed in the cylinder head. The camshaft contacts a pivot lever for activating the valves, and a supporting body for adjusting the valve stroke, by way of transfer elements. An intermediate element of a transfer element is mounted in supporting and displaceable manner, twice on the supporting body, and on the pivot lever. In this connection, the intermediate element engages a supporting surface disposed on the supporting body, by way of a supporting cam segment disposed on the intermediate element, and second with the controlling cam segment of the supporting body, and third with the pivot lever, by way of an outer contour surface disposed on the intermediate element.

The intermediate element indirectly contacts the cam of the camshaft, by way of a roller disposed on an oscillating crank. The pivoting oscillating crank is connected with the intermediate element in articulated manner, by way of a lever disposed on it.

For valve stroke adjustment and/or for adjustment of the valve opening and/or valve closing angle, the oscillating crank is disposed on the pivoting supporting body in an articulated manner. A variant for valve stroke adjustment and/or for adjustment of the valve opening and/or valve closing angle provides for disposing the supporting body on the cylinder head in fixed manner, and for providing the oscillating crank, which is now no longer connected with the supporting body, with an adjustment device for pivoting the oscillating crank.

The advantage of the device according to the invention consists in a compact method of construction that makes it possible to concentrate the components, such as camshaft, supporting body, pivot lever, and transfer elements in the smallest possible space.

Another significant advantage of the solution according to the invention consists in the fact that the force transfer point from the intermediate element to the supporting body always lies between the contact point of the supporting cam segment of the intermediate element on the journal of the supporting body and the contact point of the roller disposed on the intermediate element and the controlling cam segment of the supporting body. In this way, the result is achieved that the intermediate element is constantly pressed against the supporting body. This prevents the intermediate element from possibly pivoting out of the device. At the same time, the forces to be transferred are minimized by means of this arrangement.

Automatic displacement of the valve closing angle takes place in the case of a stroke adjustment, by means of the coupling of the intermediate element with the pivoting supporting body, by way of an oscillating crank or by means of placing an adjustment device on the oscillating crank if the supporting body is disposed fixed in place on the cylinder head, in connection with a lever disposed on the oscillating crank, in an articulated manner. The controlling cam segment on the supporting body, which co-determines the valve opening, can be designed in such a manner that a change in the stroke height and the position of the valve opening and/or valve closing angle takes place at the same time, by means of the displacement of the controlling cam segment and of the intermediate element coupled with the supporting body.

Another advantage of the valve gear according to the invention is that the valve opening angle can be kept almost constant by means of the configuration of the controlling cam segment and the outer contour surface of the intermediate element, in connection with the adjustment of the intermediate element by means of the pivoting oscillating crank, while the closing angle is adjustable between early and late. In this connection, the stroke height of the valve lifting curve is also changeable, and minimization of the valve stroke can be kept low. This is particularly advantageous for use of the valve gear according to the invention for an inlet valve. In use of the gear for an outlet valve, it is advantageous, for example, to leave the closing angle of the outlet valve almost constant, while the opening angle of the outlet valve is adjusted to early or late. In this connection, variation of the valve stroke can also take place.

In a preferred embodiment, the supporting surface disposed on the supporting body is formed by a journal disposed on the supporting body, on which the intermediate element is mounted and supported, by way of the supporting cam segment. The journal can be disposed on the supporting body in the pivot axle.

The intermediate element can engage the controlling cam segment of the supporting body by way of a roller disposed on the intermediate element. In addition, there can be a roller disposed on the oscillating crank, which roller contacts contour of the cam. The outer contour surface of the intermediate element can contact the pivot lever by way of a roller disposed on the pivot lever.

The oscillating crank on the supporting body can be disposed on the cylinder head so as to pivot about the pivot axle in an articulated manner.

There can be an eccentric adjustment that acts on the supporting body and is disposed to pivot the supporting body about the pivot axle. The supporting body can be disposed on the cylinder head in a fixed manner, and the oscillating crank is provided with an adjustment device for pivoting the oscillating crank, for valve stroke adjustment and/or for adjustment of the valve opening and/or valve closing angle. The adjustment device can be an eccentric adjustment.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
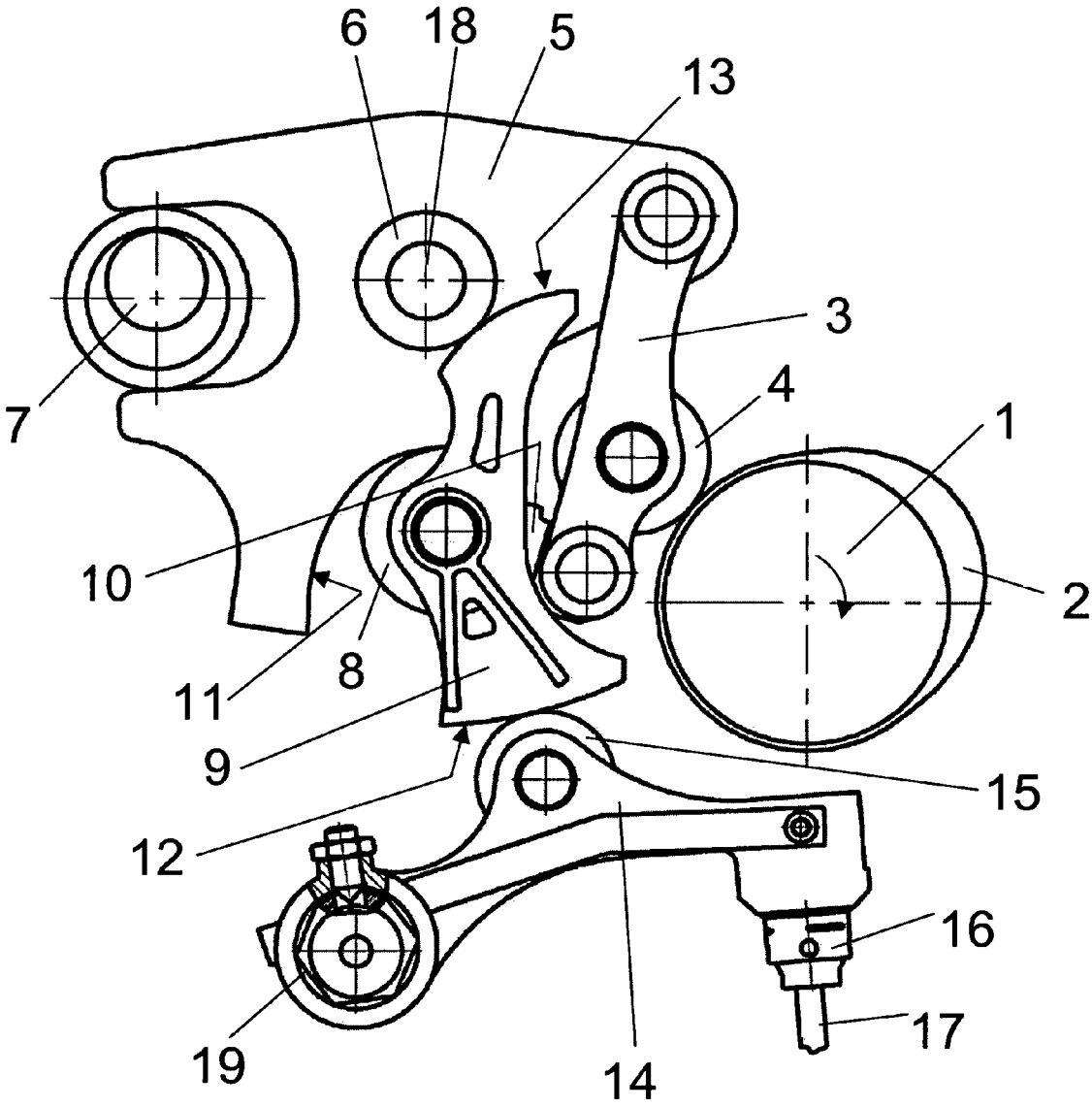
FIG. 1 shows a schematic representation of the valve gear according to the invention, in the case of a maximal stroke adjustment and with a closed valve.

The variable valve gear for internal combustion engines, according to the invention, will be explained using the example of an inlet valve. The solution according to the invention can also be used for the outlet valves of an internal combustion engine. The valve gear has a camshaft 1 with a cam 2, which, with the interposition of a transfer mechanism, moves a pivot lever 14 and thereby a valve 17, which can be closed and is held closed by means of spring force. Only the stem end of valve 17 is shown, which end rests against a play equalization element 16 that is disposed in pivot lever 14. Pivot lever 14 is mounted on an axle guided in the cylinder head, with the interposition of an eccentric bushing 19. Pivoting eccentric bushing 19 additionally adapts the pivot lever position in interaction with the play equalization element 16.

The displaceable transfer mechanism consists essentially of an intermediate element 9 and a lever 10 disposed on the intermediate element 9, in articulated manner, and the pivoting oscillating crank 3 disposed on it in articulated manner. A roller 4 is disposed on oscillating crank 3, which roller contacts the contour of cam 2 of camshaft 1.

Figure 2:
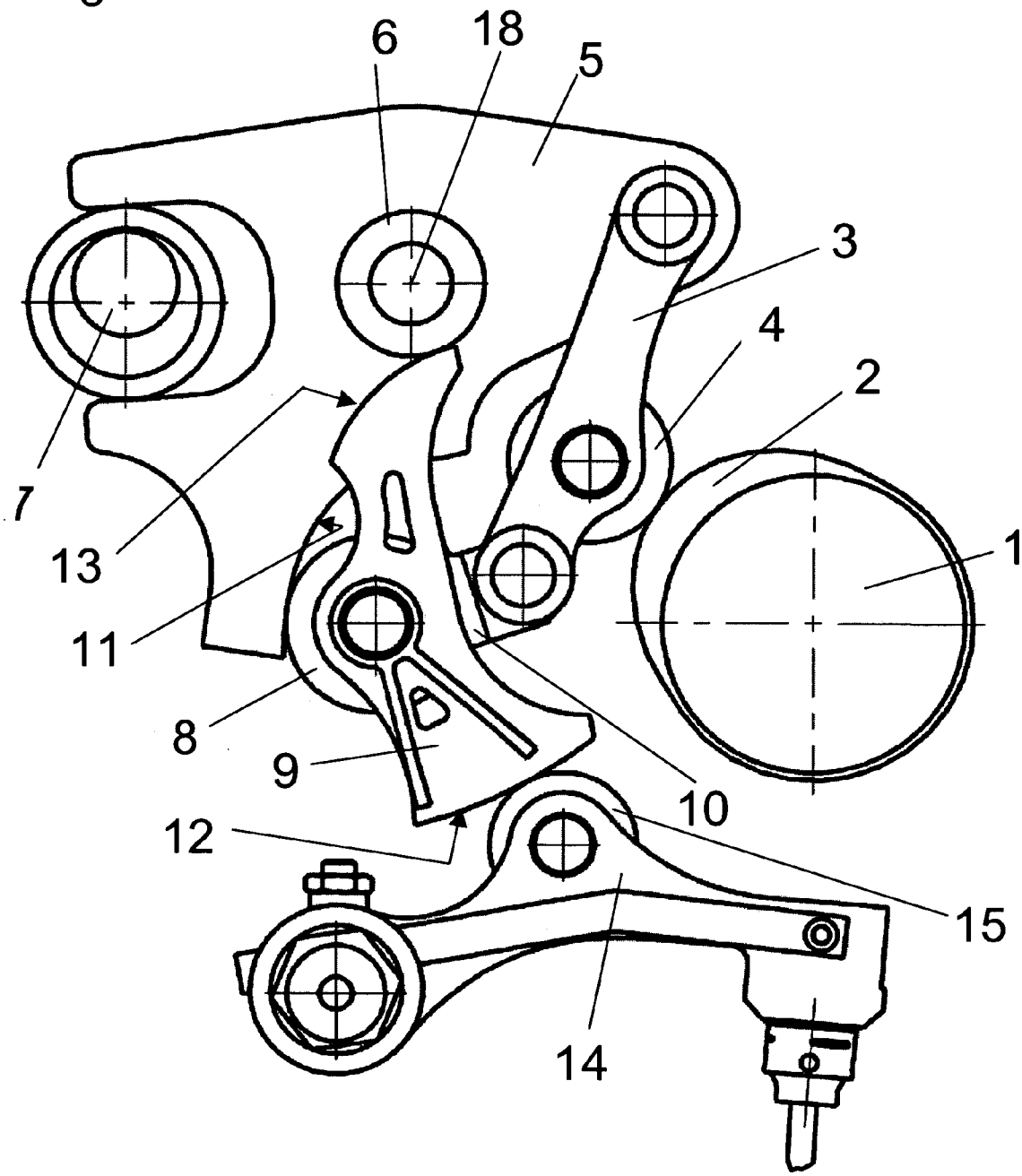
FIG. 2 shows a schematic representation of the valve gear according to the invention, in the case of a maximal stroke adjustment and with a completely open valve.
Figure 3:
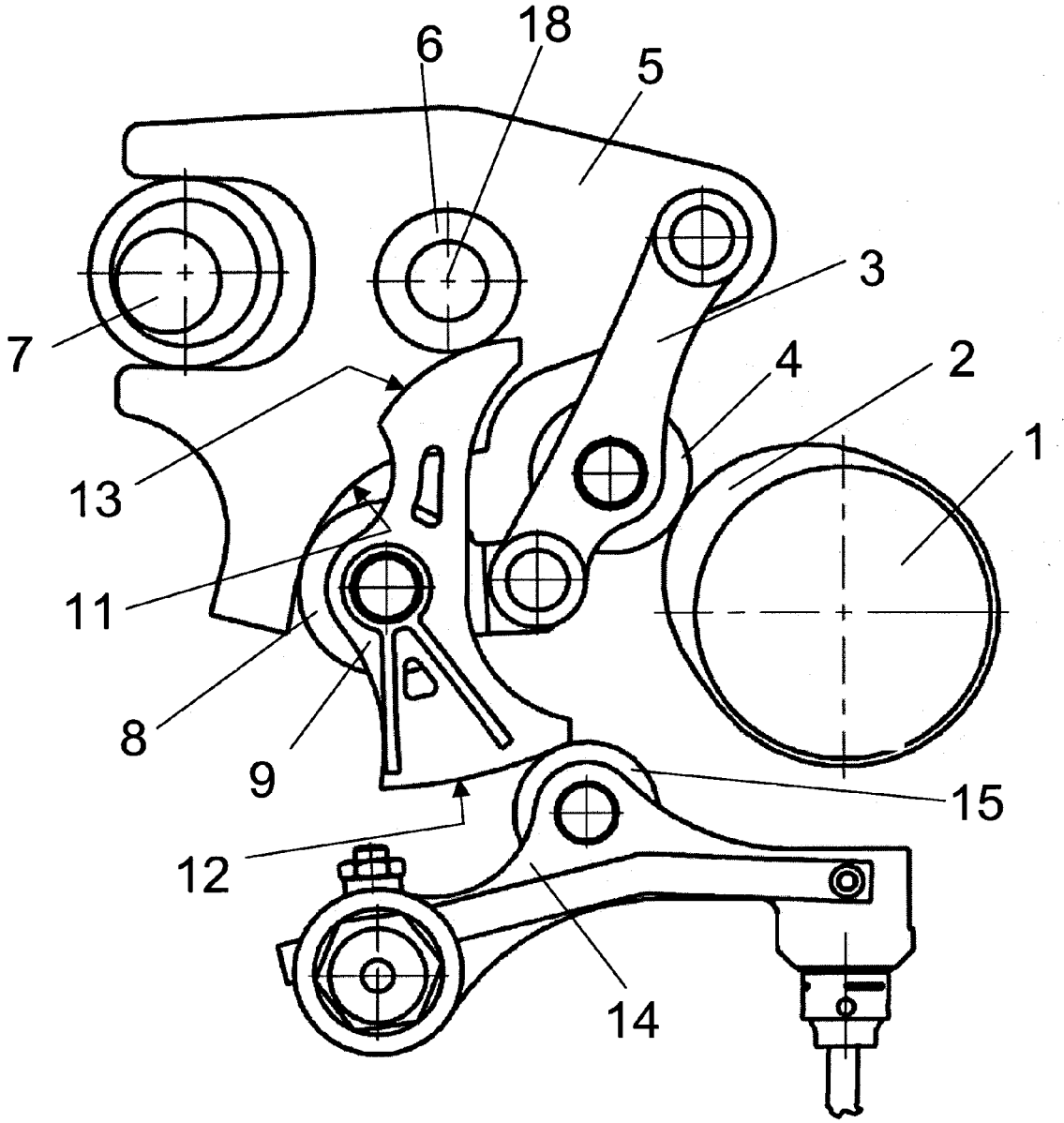
FIG. 3 shows a schematic representation of the valve gear according to the invention, in the case of a minimal stroke adjustment and with an open valve.

Pivoting of oscillating crank 3 takes place, according to the invention, in two different ways. In accordance with a first embodiment, a supporting body 5 is disposed on the cylinder head so as to pivot about pivot axle 18 and, as shown in FIGS. 1 to 3, connected with oscillating crank 3. When supporting body 5 is pivoted by means of an eccentric adjustment 7, oscillating crank 3 is pivoted at the same time, resulting in a displacement of intermediate element 9 on supporting body 5, for valve stroke adjustment and/or adjustment of the valve opening and/or valve closing angle.

Figure 4:
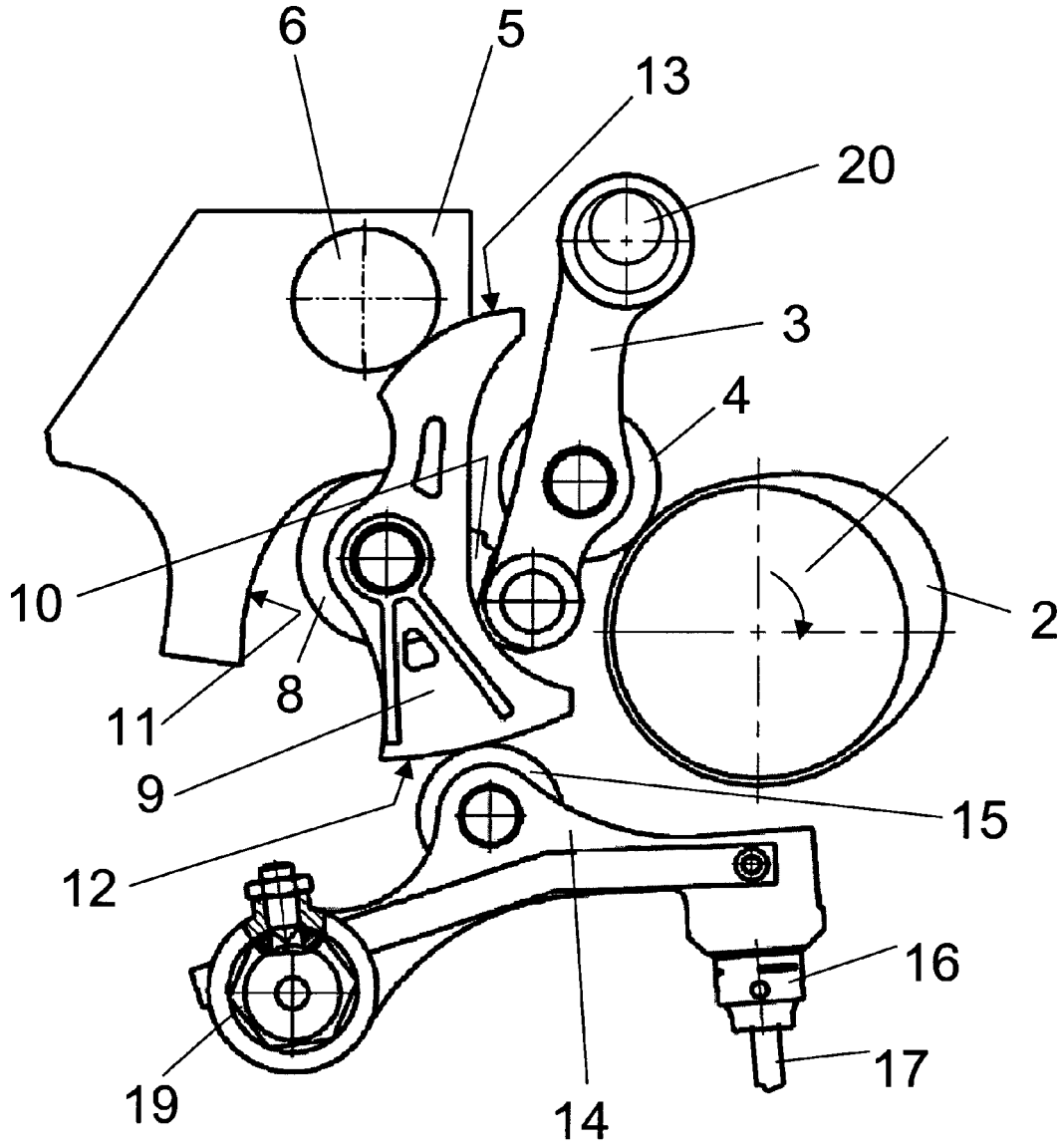
FIG. 4 shows a variant of the valve gear according to the invention, in the case of a maximal stroke adjustment and with a closed valve.
Figure 5:
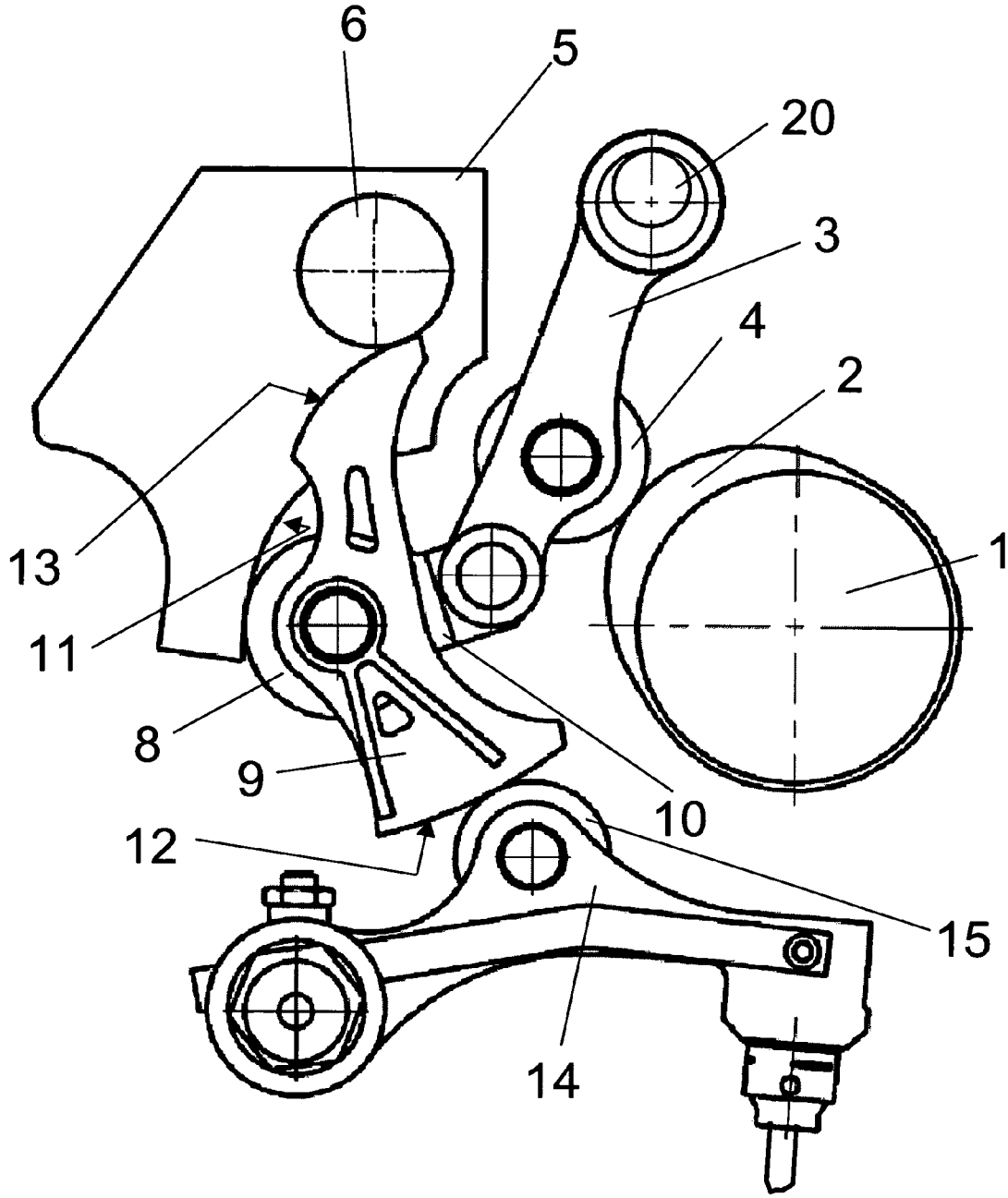
FIG. 5 shows a schematic representation of the valve gear according to the invention, in the case of a maximal stroke adjustment and with a completely open valve according to FIG. 4.

A variant of the solution according to the invention provides that supporting body 5 be disposed on the cylinder in fixed manner, as shown in FIGS. 4 and 5. In this connection, oscillating crank 3 is no longer connected with the supporting body. Pivoting of oscillating crank 3 and thereby a displacement of intermediate element 9 on supporting body 5, for valve stroke adjustment and/or for adjustment of the valve opening and/or valve closing angle, takes place via an adjustment device 20 that is disposed on oscillating crank 3. Adjustment device 20 is preferably an eccentric adjustment.

In the case of both variants, intermediate element 9 is mounted on supporting body 5 and on pivot lever 14 in a supporting manner. In this connection, support of intermediate element 9 on supporting body 5 occurs on a supporting surface disposed on supporting body 5, and on a controlling cam segment 11 disposed on supporting body 5. The supporting surface disposed on supporting body 5 is preferably the outer surface of a journal 6 disposed on supporting body 5, on which supporting cam segment 13 disposed on intermediate element 9 is supported. According to the first variant, in which supporting body 5 can pivot and oscillating crank 3 is disposed on supporting body 5, journal 6 is disposed about pivot axle 18 of supporting body 5.

A roller 8 is disposed on intermediate element 9, which connects with controlling cam segment 11 disposed on supporting body 5. Intermediate element 9 is supported on a roller 15 disposed on pivot lever 14, by way of an outer contour surface 12 disposed on intermediate element 9. Pivot lever 14 is pivoted in the counter-clockwise direction by means of the valve spring, not shown, and thereby intermediate element 9 is pressed against supporting body 5 by way of roller 15. In this way, intermediate element 9 is securely mounted between supporting body 5 and pivot lever 14, and is displaced along controlling cam segment 11 of supporting body 5 in accordance with the engagement of cam 2.

The valve gear according to the invention operates as follows:

The first variant of the solution according to the invention, shown in FIG. 1, shows a closed valve in the case of a maximally adjusted valve stroke. In this connection, eccentric adjustment 7 has pivoted supporting body 5 about pivot axle 18, in the counter-clockwise direction, into the position shown, and roller 4 of oscillating crank 3 engages the base circle of cam 2. To open the valve, cam 2 shown in FIG. 1 is turned in the clockwise direction. By turning camshaft 1, as shown in FIG. 2, roller 4 is displaced by cam 2, thereby pivoting oscillating crank 3 about its articulation point on supporting body 5, in the clockwise direction. As a result of the pivoting of oscillating crank 3, intermediate element 9, which is connected with oscillating crank 3 in an articulated manner, by way of lever 10, is displaced along controlling cam segment 11 of supporting body 5, by way of roller 8. In this displacement, supporting cam 13 of intermediate element 9 slides along the surface of journal 6. At the same time, outer contour surface 12 of intermediate element 9 presses pivot lever 14 down, as it slides over roller 15, and valve 17 is displaced and releases the inlet channel. Because of the position and the configuration of controlling cam segment 11 disposed on supporting body 5, different stroke adjustments of the valve 17 are achieved as roller 8 of intermediate element 9 slides along controlling cam segment 11. In FIG. 2, a completely open valve 17 is shown at a maximal stroke adjustment.

In FIG. 3, an open valve 17 at a minimally adjusted valve stroke is shown. By means of adjusting eccentric adjustment 7, supporting body 5 shown in FIGS. 1 and 2 is pivoted about pivot axle 18 in the clockwise direction. With this, the position of controlling cam segment 11 also changes, as does the position of intermediate element 9 that engages it, so that in the case of complete engagement of cam 2 on roller 4, pivot lever 14 is pivoted by only a minimal amount. Because of the coupling of intermediate element 9 with supporting body 5 by way of oscillating crank 3 and lever 10, intermediate element 9 is also displaced when supporting body 5 is pivoted, in such a manner that when a variably adjusted valve stroke height is set, the valve opening and/or valve closing angle can be adjusted at the same time.

In FIGS. 4 and 5, a variant of the invention is shown, as described above. In this connection, the same components are provided with the same reference numbers. During opening and closing of valve 17, analogous to FIGS. 1 to 3, as described, intermediate element 9 is displaced along controlling cam segment 11 of supporting body 5, by means of cam 2 and oscillating crank 3 and lever 10. However, supporting body 5 is firmly connected with the cylinder head. The adjustment of different valve strokes and/or the adjustment of the valve opening and/or valve closing angle takes place by means of the eccentric adjustment of adjustment device 20 disposed on oscillating crank 3. Oscillating crank 3 is displaced by the eccentric adjustment of adjustment device 20, and thereby the position of intermediate element 9 on controlling cam segment 11 of supporting body 5 is changed, by way of lever 10 articulated onto oscillating crank 3. According to FIG. 4, valve 17 is closed, while according to FIG. 5, valve 17 is open.

Accordingly, while only a few embodiments of the present invention have been shown and described, it is obvious that many changes and modifications may be made thereunto without departing from the spirit and scope of the invention.

LIST OF REFERENCE SYMBOLS USED

1 camshaft
2 cam
3 oscillating crank
4 roller
5 supporting body
6 journal
7 eccentric adjustment
8 roller
9 intermediate element
10 lever
11 controlling cam segment
12 outer contour surface
13 supporting cam segment
14 pivot lever
15 roller
16 play equalization element
17 valve
18 pivot axle
19 eccentric bushing
20 adjustment device

What is claimed is:

1. A variable valve gear for an internal combustion engines having a cylinder head, comprising;

at least one camshaft disposed in the cylinder head;

a pivot lever disposed in the cylinder head, the lever contacting a valve that closes by means of spring force;

a supporting body disposed on the cylinder head, said supporting body having a controlling cam segment for valve stroke adjustment;

an intermediate element guided between the supporting body and the pivot lever and engaging first a supporting surface disposed on the supporting body, by way of a supporting cam segment disposed on the intermediate element, second a controlling cam segment of the supporting body, and third the pivot lever, by way of an outer contour surface of the intermediate element, said intermediate element being displaceable by way of a cam of the camshaft, the cam contacting the intermediate element via a pivoting oscillating crank and a lever disposed between the intermediate element and the oscillating crank, in an articulated manner.

2. A variable valve gear according to claim 1, wherein the supporting surface disposed on the supporting body is formed by a journal on which the intermediate element is mounted and supported, by way of the supporting cam segment.

3. A variable valve gear according to claim 1, wherein the intermediate element engages the controlling cam segment of the supporting body by way of a roller disposed on the intermediate element.

4. A variable valve gear according to claim 1, further comprising a roller disposed on the oscillating crank, which roller contacts a contour of the cam.

5. A variable valve gear according to claim 1, wherein the outer contour surface of the intermediate element contacts the pivot lever by way of a roller disposed on the pivot lever.

6. A variable valve gear according to claim 1, wherein the oscillating crank is disposed on the supporting body so as to pivot about a pivot axle, in an articulated manner.

7. A variable valve gear according to claim 2, wherein the journal is disposed on the supporting body in a pivot axle.

8. A variable valve gear according to claim 7, wherein an eccentric adjustment that acts on the supporting body is disposed to pivot the supporting body about the pivot axle.

9. A variable valve gear according to claim 1, wherein the supporting body is disposed on the cylinder head in a fixed manner, and the oscillating crank is provided with an adjustment device for pivoting the oscillating crank, for valve stroke adjustment and/or for adjustment of the valve opening or valve closing angle.

10. A variable valve gear according to claim 9, wherein the adjustment device is an eccentric adjustment.

* * * * *